US008436841B2

(12) United States Patent
Maru et al.

(10) Patent No.: US 8,436,841 B2
(45) Date of Patent: May 7, 2013

(54) DISPLAY APPARATUS

(75) Inventors: Hiroyuki Maru, Kawasaki (JP); Masami Iseki, Mobara (JP); Fujio Kawano, Kawasaki (JP); Tatsuhito Goden, Chiba (JP); Takanori Yamashita, Chiba (JP); Kouji Ikeda, Chiba (JP); Takeshi Izumida, Mobara (JP); Hiroshi Kageyama, Hachioji (JP)

(73) Assignees: Canon Kabushiki Kaisha, Tokyo (JP); Hitachi Displays, Ltd., Chiba-ken (JP)

( * ) Notice: Subject to any disclaimer, the term of this patent is extended or adjusted under 35 U.S.C. 154(b) by 649 days.

(21) Appl. No.: 12/619,026

(22) Filed: Nov. 16, 2009

(65) Prior Publication Data

US 2010/0128160 A1 May 27, 2010

(30) Foreign Application Priority Data

Nov. 18, 2008 (JP) ..... 2008-294369

(51) Int. Cl.
*G09G 3/30* (2006.01)

(52) U.S. Cl.
USPC ..... 345/204; 345/205

(58) Field of Classification Search ..... None
See application file for complete search history.

(56) References Cited

U.S. PATENT DOCUMENTS

| | | | | |
|---|---|---|---|---|
| 4,714,921 | A | 12/1987 | Kanno et al. | 340/784 |
| 4,779,086 | A | 10/1988 | Kanno et al. | 340/805 |
| 6,462,722 | B1 | 10/2002 | Kimura et al. | 345/76 |
| 6,522,315 | B2 | 2/2003 | Ozawa et al. | 345/92 |
| 6,618,029 | B1 | 9/2003 | Ozawa | |
| 6,839,045 | B2 | 1/2005 | Ozawa et al. | 345/92 |
| 7,098,989 | B2 * | 8/2006 | Wu | 349/192 |
| 7,180,483 | B2 | 2/2007 | Kimura et al. | 345/76 |
| 7,221,339 | B2 | 5/2007 | Ozawa et al. | 345/76 |
| 7,253,793 | B2 | 8/2007 | Ozawa et al. | 345/76 |

(Continued)

FOREIGN PATENT DOCUMENTS

| | | | |
|---|---|---|---|
| CN | 1728895 | A | 2/2006 |
| CN | 101153961 | A | 4/2008 |

(Continued)

OTHER PUBLICATIONS

Chinese Office Action dated Dec. 1, 2011, in related corresponding Chinese Patent Application No. 200910212198.9 (with English translation).

*Primary Examiner* — Joseph Haley
(74) *Attorney, Agent, or Firm* — Fitzpatrick, Cella, Harper & Scinto

(57) ABSTRACT

A display apparatus includes data lines, scanning lines arranged to cross the data lines, and pixel circuits aligning along the data lines and the scanning lines, such that one of the pixel circuits corresponds to each intersection between the data lines and the scanning lines. In addition, image signal lines transmit image signals, and switches connect the data lines to the image signal lines so that each of the data lines is connected to one of the image signal lines. The data lines are arranged such that adjacent data lines form a pair of data lines, and adjacent pairs of data lines are spaced apart from each other by two columns of pixel-circuits. Respective data lines of the pair of data lines are connected by the switches to two different image signal lines, and the switches connecting the pair of data lines to corresponding image signal lines are activated simultaneously.

8 Claims, 9 Drawing Sheets

U.S. PATENT DOCUMENTS

| | | | | |
|---|---|---|---|---|
| 7,397,451 | B2 | 7/2008 | Ozawa | |
| 7,460,094 | B2 | 12/2008 | Ozawa | |
| 7,532,207 | B2 | 5/2009 | Kawasaki et al. | |
| 8,310,475 | B2 | 11/2012 | Ozawa | |
| 8,310,476 | B2 | 11/2012 | Ozawa | |
| 8,334,858 | B2 | 12/2012 | Ozawa | |
| 2003/0151568 | A1 | 8/2003 | Ozawa | |
| 2003/0193493 | A1 | 10/2003 | Ozawa | |
| 2003/0231273 | A1 | 12/2003 | Kimura et al. | 349/139 |
| 2005/0052371 | A1 | 3/2005 | Ozawa | |
| 2005/0122150 | A1 | 6/2005 | Iseki et al. | |
| 2006/0017393 | A1 | 1/2006 | Kang et al. | |
| 2006/0023150 | A1 | 2/2006 | Mochizuki | |
| 2006/0034125 | A1* | 2/2006 | Kim et al. | 365/185.22 |
| 2006/0114194 | A1 | 6/2006 | Kawasaki et al. | |
| 2006/0114195 | A1 | 6/2006 | Yamashita et al. | |
| 2006/0132395 | A1 | 6/2006 | Kawasaki et al. | |
| 2006/0273995 | A1 | 12/2006 | Ozawa et al. | 345/76 |
| 2006/0273996 | A1 | 12/2006 | Ozawa et al. | 345/76 |
| 2006/0279491 | A1 | 12/2006 | Ozawa et al. | 345/76 |
| 2008/0157828 | A1 | 7/2008 | Kawasaki et al. | |
| 2008/0158112 | A1 | 7/2008 | Kawasaki et al. | |
| 2008/0158209 | A1 | 7/2008 | Ozawa | |
| 2008/0165174 | A1 | 7/2008 | Ozawa | |
| 2008/0198152 | A1 | 8/2008 | Ozawa | |
| 2008/0246700 | A1 | 10/2008 | Ozawa et al. | 345/76 |
| 2009/0015571 | A1 | 1/2009 | Kawasaki et al. | |
| 2009/0033599 | A1 | 2/2009 | Kawasaki et al. | |
| 2009/0072758 | A1 | 3/2009 | Kimura et al. | 315/291 |
| 2009/0085908 | A1 | 4/2009 | Kawasaki et al. | |
| 2009/0102853 | A1 | 4/2009 | Kawasaki et al. | |
| 2009/0121980 | A1 | 5/2009 | Kawasaki et al. | |
| 2009/0135110 | A1 | 5/2009 | Nakamura et al. | |
| 2009/0167148 | A1 | 7/2009 | Kimura et al. | 313/498 |
| 2009/0231239 | A1 | 9/2009 | Goden et al. | |

FOREIGN PATENT DOCUMENTS

| | | | |
|---|---|---|---|
| JP | 61-180293 | | 8/1986 |
| JP | 62-055625 | | 3/1987 |
| JP | 11-024606 | A | 1/1999 |
| JP | 2006-065287 | A | 3/2006 |
| JP | 2008-170856 | A | 7/2008 |
| WO | 98-036407 | | 8/1998 |

* cited by examiner

DISPLAY APPARATUS

BACKGROUND OF THE INVENTION

1. Field of the Invention

The present invention relates to a display apparatus and a camera, and particularly to control of a sampling unit and arrangement of data lines for preventing the degrading of image quality in the display apparatus.

2. Description of the Related Art

An active matrix type display apparatus using an organic electroluminescence element (hereafter, referred to as an organic EL element) and a liquid crystal element, etc. has a display element and a circuit for controlling the display status of the element for each pixel circuit. A transistor which makes up a pixel circuit is made up of an amorphous silicon thin-film transistor (TFT) and a polysilicon TFT, etc. Pixel circuits are selected in units of lines by a scanning line which connects pixel circuits in a row direction of a matrix, and receive image signals from a data line extending in a column direction. The image signal is generated at a data line driving circuit.

The data line driving circuits may be made up of TFTs and provided in each column of the data lines along one side of a pixel circuit matrix. Moreover, the image signal may be created at an integrated circuit connected to a display panel and transmitted to the data line through a wiring (hereafter, referred to as an image signal line) provided in the display panel.

In the latter case, if image signals of the number of data lines (that is, the number of columns of a matrix) are generated at an integrated circuit to be fed to a display panel, a large number of image signal lines needs to be arranged on the display panel. As a result, the area occupied by the image signal lines will cause an increase in the size of a so-called frame edge portion of a display panel. For that reason, a configuration has been developed in which the number of wirings is reduced by decreasing the number of outputs of the integrated circuit to be less than the number of data lines so that image signals are fed from one output to a plurality of data lines in a time division manner.

Japanese Patent Application Laid-Open No. 562-055625 proposes a circuit which connects an image signal line and a data line with a TFT switch. When the data lines are 640 and the signal lines are 8, the 640 TFT switches provided corresponding to each data line are at one end connected to a data line and, at the other end, to an image signal line at a rate of one for every 8 columns. Eight TFT switches are concurrently opened/closed by a control signal of one control line.

Image signals of the data lines of 80 columns are fed in time series to one image signal line and are successively sampled by TFT switches at data lines of 80 columns. The sampled image signals are retained in a parasitic capacitor of a data line or a holding capacitor of a pixel circuit selected by a selection signal of a scanning line.

In such a configuration that an image signal line and a data line are connected by a TFT switch, image signals of every 8 columns are concurrently fed to the data line by TFT switches which are concurrently opened/closed. That is, image signals will be successively sampled block by block, with one block including 8 columns.

In this case, Japanese Patent Application Laid-Open No. S61-180293 points out that an unintended image boundary appears at the boundary between the data lines which receive image data at different timings resulting in a degrading of image quality. This is because the pixel circuit which receives and retains an image signal from a data line is subjected to voltage variation caused by the data line of the next column which receives image signals thereafter. Japanese Patent Application Laid-Open No. S61-180293 solves the above described problem by adding the varying part of the voltage to an image signal before generating it.

By the way, in an active matrix type display apparatus using an organic EL, PCT International Publication No. WO98/036407 proposes a layout method in which a power source line is shared by adjacent pixel circuits to increase the pixel density. By arranging pixel circuits in both sides of a power source line extending in a column direction and commonly supplying power to the pixel circuits of the two columns, the number of power source lines can be decreased to reduce the spacing between the pixel circuits. In two adjoining pixel circuits aligning in the row direction, circuit elements such as transistors, capacitors, and wirings are arranged in line symmetry with respect to an axis in the column direction (hereafter, which is referred to as a flip arrangement). The data line is arranged opposite the power source line with respect to the pixel circuit. Therefore, between adjacent pixel-circuit columns, two data lines and a power source line are alternately arranged.

A new problem will arise when applying the above described configuration, in which image signal lines and data lines are connected by TFT switches, to an active matrix display apparatus in which the pixel circuits are provided in a flip arrangement.

That is, when a boundary of data lines in which image signals are sampled at different timings is placed between two data lines which are arranged between pixel circuits in flip arrangement, the data line which first receives and retains an image signal will be seriously affected by the voltage variation of the adjacent data line. In contrast, when a boundary of data lines in which image signals are sampled at different timings is placed between the data lines which are spaced apart with two columns of pixel circuits interposed therebetween, there is little influence of the voltage variation of an adjacent data line.

Thus, when data lines are arranged in groups of two, the magnitude of parasitic capacity between the data lines alternately varies resulting in that two types of boundaries with and without a large effect of voltage variation are created as the boundary between pixel-circuit columns of different sampling timings. For that reason, image signals need to be corrected by respectively different methods for every two boundaries requiring a correction circuit therefor.

SUMMARY OF THE INVENTION

It is an object of the present invention to provide a display apparatus and a camera which are free of the degrading of image quality due to the voltage variation of adjacent data lines.

The display apparatus relating to the present invention comprises: data lines; scanning lines arranged to cross the data lines; pixel circuits aligning along the data lines and the scanning lines, such that each of the pixel circuits corresponds to each of intersections between the data lines and the scanning lines; image signal lines for transmitting image signals; and switches for connecting the data lines to the image signal lines so that each of the data lines is connected to one of the image signal lines, wherein the data lines are arranged such that every two adjacent data lines are coupled to locate close to each other, the coupled two data lines are connected by the switches to different two of the image signal lines, and the switches connecting the coupled two data lines to corresponding image signal lines are activated simultaneously.

According to the present invention, it is possible to prevent cross-talks among a plurality of data lines arranged to be adjacent to each other in parallel.

Moreover, according to the present invention, it is possible to provide a display apparatus in which a power source line is shared by adjacent pixel circuits thereby achieving high layout efficiency.

Further features of the present invention will become apparent from the following description of exemplary embodiments with reference to the attached drawings.

DESCRIPTION OF THE EMBODIMENTS

Figure 1:
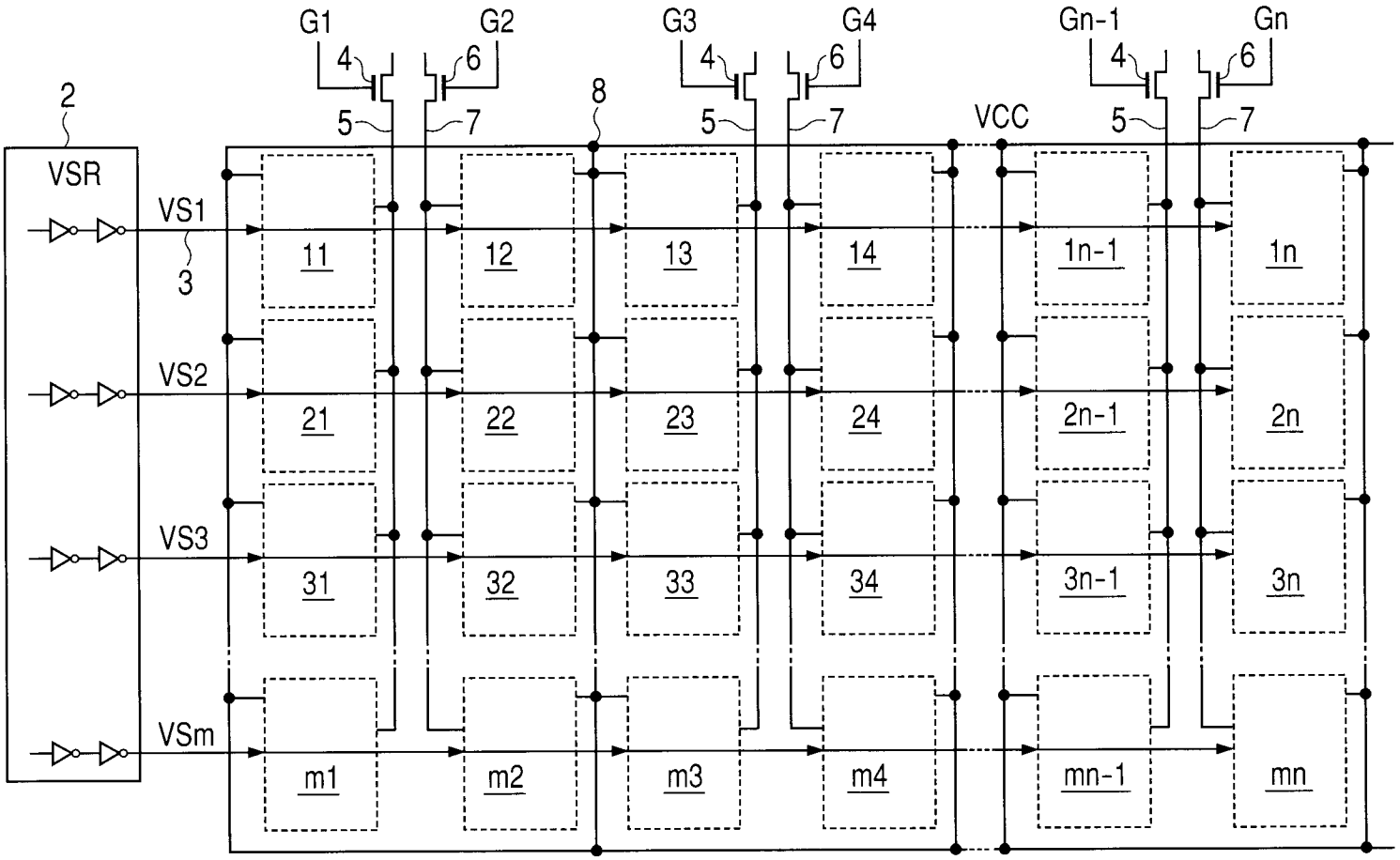
FIG. 1 is a configuration diagram to illustrate the configuration of an exemplary embodiment of the display apparatus relating to the present invention.

FIG. 1 illustrates the configuration of a display apparatus relating to the present invention.

In a display apparatus of the present invention, pixel circuits 11 to mn each of which is made up of a light emitting element, which is made up of an organic EL light emitting layer and electrodes sandwiching it, and a circuit for supplying current thereto are arranged in the form of a matrix of m rows and n columns (m and n are each a natural number not less than two).

The pixel circuits 11 to mn are arranged corresponding to each of the intersections between m scanning lines and n data lines, and are in a matrix arrangement along the data line and scanning line.

The data lines 5 and 7 are each commonly connected to pixel circuits arranged in a column direction (longitudinal direction in FIG. 1) to transmit image signals to the pixel circuits. The scanning line 3 is commonly connected to pixel circuits disposed in a row direction (lateral direction in FIG. 1) and is applied with a scanning selection signal.

One (or a plurality of) scanning line 3 for each of the rows of pixel circuits 11 to 1*n*, pixel circuits 21 to 2*n*, . . . , and pixel circuits m1 to mn, is arranged and connected to each pixel circuit. The scanning line 3 is applied with scanning signals VS1 to VSm for controlling the writing of image information transmitted by data lines, into pixel circuits. The scanning signals are generated by a scanning signal generation circuit (VSR) 2.

The data line is connected to pixel circuits of pixel-circuit columns made up of pixel circuits 11 to m1, pixel circuits 13 to m3, and pixel circuits 1*n* to mn with the left most pixel-circuit column being the first column.

Arrangement is made that not all of the data lines are equally spaced, but each two of them form a pair and are disposed closer to each other than to other data lines. The two data lines 5 and 7 which form a pair and are closely spaced are arranged between the same pixel-circuit columns. In FIG. 1, the two data lines 5 and 7 disposed side by side are coupled and arranged between pixel circuits of an odd column and pixel circuits of the even column on immediate right side.

The power source line 8 for conveying source voltage to pixel circuits is arranged between two groups of pixel-circuit columns and commonly supplies source voltage to the pixel circuits of the two columns on both sides. The power source line 8 is arranged between a pixel-circuit column of an even column and a pixel-circuit column of an odd column on right side, and is commonly connected to those pixel circuits. That is, the space between pixel-circuit columns, in which the power source line 8 is disposed, and the space between pixel-circuit columns, in which a pair of data lines are disposed, alternate with each other.

Although, in FIG. 1, the power source line 8 is arranged in parallel with the data lines 5 and 7, the power source line 8 may be arranged in parallel with the scanning line 3. The term "parallel" herein implies a nearly parallel state which does not mean a perfectly parallel state, but can be regarded as a parallel state.

Moreover, although, in FIG. 1, the power source line 8 is arranged on the further left of the left end pixel-circuit column, and the data line is arranged on the right side, this arrangement may be reversed. That is, the data line 7 may be disposed on the further left of the left end pixel-circuit column, and the power source line 8 may be disposed on the right side. In this case, since the left end pixel-circuit column has no counterpart pixel-circuit column to form a group therewith, it is assumed to solely make up a first pixel-circuit column group.

Although, in FIG. 1, the data lines 5 and 7 and the scanning line 3 are arranged so as to cross orthogonally (to form right angles), they do not necessarily need to be arranged to form right angles provided they intersect with each other. Moreover, the data lines 5 and 7 and the scanning line 3 are each not limited to a straight line. When the pixels are arranged in a honeycomb state, the data lines and the scanning lines are arranged in a meandering way according to the pixel shape.

Each of the data lines is provided with switches 4 and 6 which will be a sampling unit (hereafter, referred to as sampling switch). Although not shown in FIG. 1, a terminal of the sampling switch opposite the terminal connected to the data line is connected with an image signal line (Videos 1, 2, . . . of FIG. 2). The image signal line is a wiring to transmit image signals received as input by the display apparatus to the data line. The sampling switches 4 and 6 are each a transistor formed of a thin film (TFT).

In the present invention, the control signals input to the gates of two sampling switches 4 and 6 provided in the paired data lines have always the same timings of an H (High) level and a L (Low) level. In FIGS. 1, G1 and G2, G3 and G4, . . . , and Gn−1 and Gn are control signals each having the same timing. That is, the two sampling switches 4 and 6 belonging to the same pixel-circuit column turns on/off concurrently.

Thus, in the present invention, the sampling switches 4 and 6 connected to two coupled data lines, which belong to a pixel-circuit column group and are closely spaced to run parallel, are controlled by the same sampling signal. The sampling timings of the two coupled data lines in the same pixel-circuit column group are always the same, and the boundary between the columns of different sampling timings will be between the two data lines separated by two columns of pixel circuits. As a result of that, not only the need of performing two types of data correction according to the boundary of columns of different sampling timings is eliminated, but also the capacity coupling between the data lines becomes quite small so that there is no voltage variation due to an adjacent data line thus eliminating the need of the data correction at boundary itself.

Example 1

Figure 2:
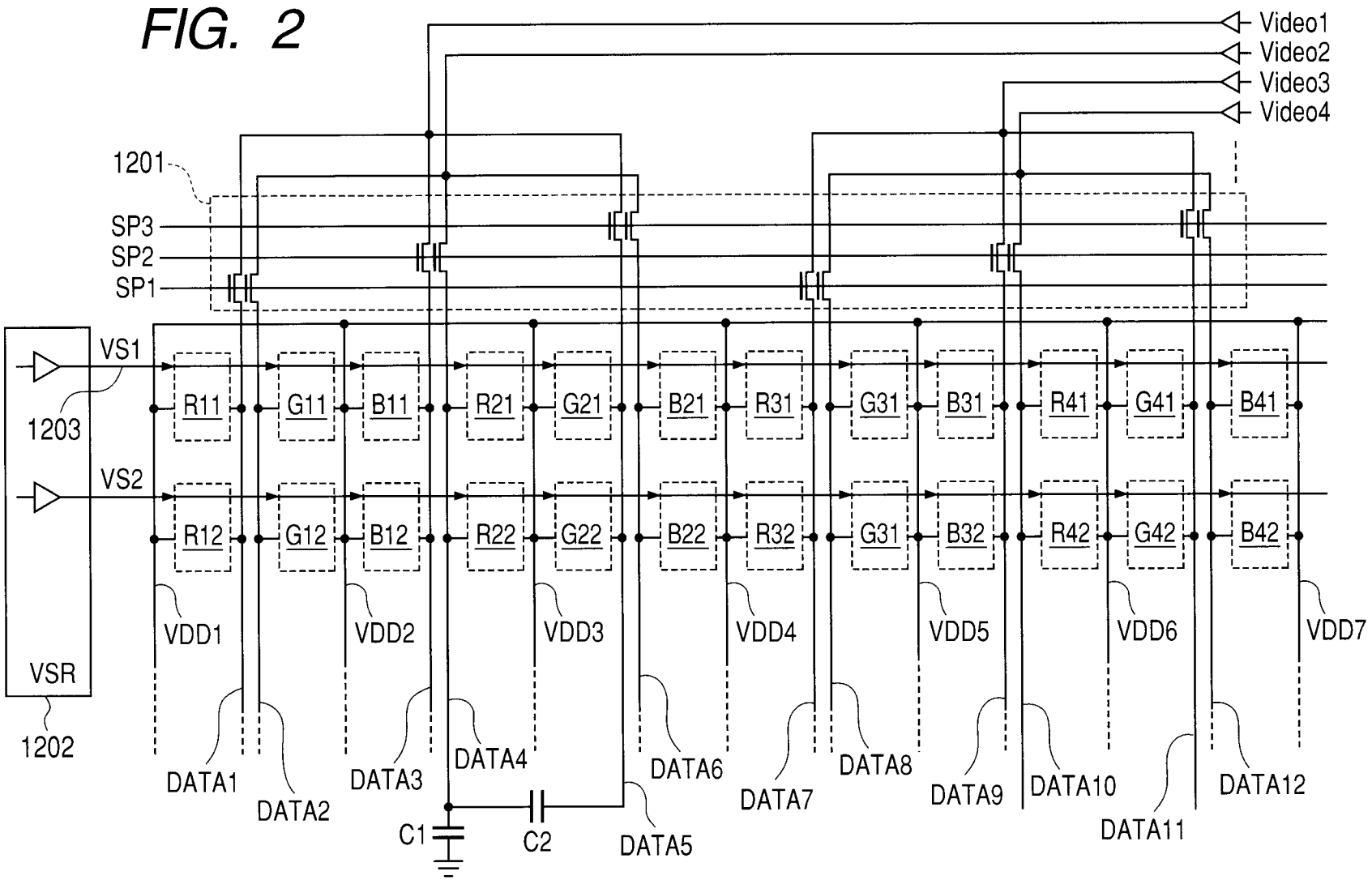
FIG. 2 is a circuit diagram of a first example.

FIG. 2 is a circuit block diagram of a display apparatus which is a first example of the present invention, and to which wirings connecting to sampling switches of the circuit of FIG. 1 are added. Although, in an actual apparatus, the pixel circuit is arranged in the form of a matrix of 800 rows and 1920 columns, only part of it is drawn in FIG. 2.

The pixel circuits R11, G11, . . . are each made up of a light emitting element, in which an organic EL light emitting layer is sandwiched by electrodes, and a pixel circuit for supplying current thereto.

Among the pixels of FIG. 2, a pixel circuit of a symbol starting with R such as R11 includes a light emitting element of red and is colored with red. A pixel circuit of a symbol starting with G such as G11 includes a light emitting element of green and is colored with green. A pixel circuit of a symbol starting with B such as B11 includes a light emitting element of blue and is colored with blue. The pixels with three different colors are arranged periodically in a row direction along the scanning line, and pixel circuits of the same color are arranged in a column direction.

The display apparatus of FIG. 2 on the whole is formed on a single substrate. An integrated circuit chip not shown is connected to the same substrate, and 640 lines of image signals are generated at a data line driving circuit not shown and built therein, and are output to the image signal lines Video 1, Video 2, . . . , Video 640. The image signal lines Video 1 to Video 640 are wirings along the upper side of pixels arranged in the form of a matrix and transmit image signals to the data lines DATA1, DATA2, . . . , DATA 1920.

While the number of image signal lines is specified by a permissible width of the frame edge, it is normally set to be a number smaller than that of the columns of the pixel matrix, that is, the number of data lines, in order to decrease the width of the frame edge as much as possible. Each image signal line includes a fixed plural number of image data in time series, and is successively connected one by one at different times to data lines of a corresponding number to transmit image signals.

In this way, one image signal line Video k (k=1, 2, 3, . . . , 640) transmits image signals to each of the corresponding plurality (three in FIG. 2) of data lines DATAn (n=1, 2, . . . , 1920) at different times. Each image signal line is connected to a predetermined plurality of data lines which will be the counterparts of the transmission of image signals via switches. These switches 1201 are provided at positions where extended data lines intersect with image signal lines.

Switches 1201 are each made up of switches of thin film transistor (4 and 6 in FIG. 1), which are provided one by one corresponding to each data line. Each switch connects a data line DATAi with an image signal line Videoj which transmits image signals thereto. Each thin film transistor which makes up the switches 4 and 6 has its drain connected to a data line, and its source connected to an image signal line, and its gate receives as input a signal to control the open/close of the switches 4 and 6.

When switches 4 and 6 are closed, an image signal of an image signal line is transmitted to a data line to be retained by a capacity C1 which is included in the data line itself. The switches 4 and 6 are each a sampling switch to perform the sampling of image signals.

In the present example, 1920 data lines and 640 image signal lines are provided and one image signal line supplies image signals to 1920/640=3 data lines. The image signal line Video 1 supplies image signals to the data lines of the 1st, 3rd, and 5th columns, and the image signal line Video2 to the data lines of the 2nd, 4th, and 6th columns. Then, three data lines are selected at a rate of one for every other column, in other words, one out of two columns, and are connected to three switches.

The three switches connected to one image signal line successively turn on at different times to perform the sampling of image signals. For that purpose, in the present example, three sampling signals SP1, SP2 and SP3 are each input into a gate to control the open/close of each switch.

When the sampling signals SP1 to SP3 are at a High (H) level, the switches turn on to sample image signals to the data lines. The sampling signals SP1, SP2 and SP3 turn on the switches at times which do not coincide with each other.

On the other hand, when the sampling signals SP1 to SP3 are at a Low (L) level, the switches turn off to hold the sampled image signals in the parasitic capacitor of the data line. At the same time, a selection signal is input into the scanning line and an image signal level is also held in a pixel circuit of the selected row.

During a period in which one sampling signal line is at an H level, 640 data lines are concurrently sampled, and this is successively performed by three sampling signals, and image signals are sampled into a total of 1920 data lines.

The scanning line 1203 is connected to pixel circuits of each row, and pixel circuits are selected in units of row. The scanning line 1203 is applied with scanning signals VS1, VS2, . . . , VSm which control the writing of data line information into pixel circuits. The scanning signals are generated by the scanning signal generation circuit 1202.

Figure 3:
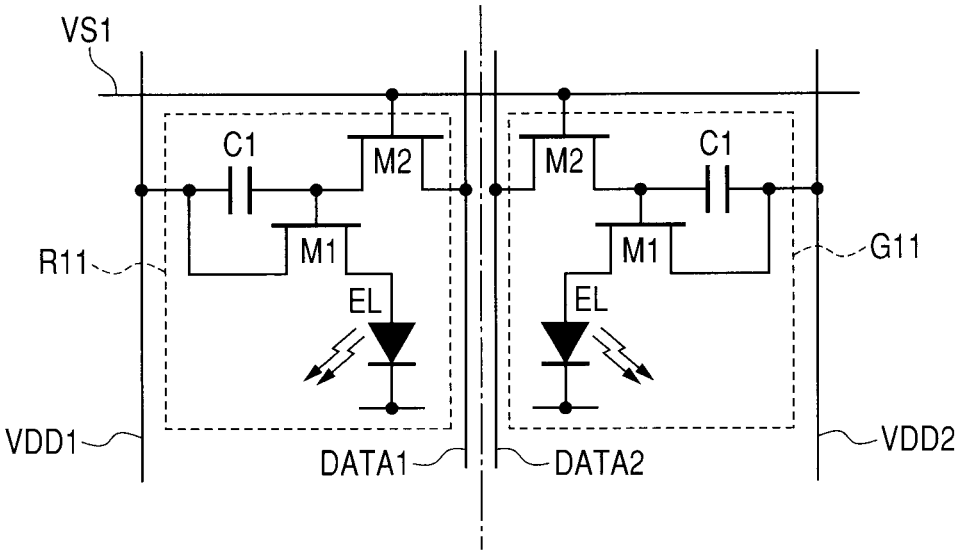
FIG. 3 is a pixel circuit diagram of the first example.

The configuration of the pixel circuits R11, G11, . . . of FIG. 2 is illustrated in FIG. 3. FIG. 3 illustrates two data lines DATA1 and DATA2 which are closely spaced forming a pair and, on both sides thereof, two pixel circuits R11 and G11 which are adjacent to each other in the scanning line direction.

Pixels are connected to the same scanning line as illustrated in FIG. 3, and two pixel circuits, which are in relation to sandwich two data lines, forms a pair. Hereafter, description will be made supposing that the two pixel circuits forming a pair are R11 and G11.

The pixel circuit R11 is made up of a light emitting element EL in which an organic EL light emitting layer is sandwiched by electrodes, a driving transistor M1, a switching transistor M2, a capacitor C1, and wirings The gate of the switching transistor M2 is connected to the scanning line VS1, the source is connected to the data line DATA1, and the drain is connected to one terminal of the capacitor C1 and the gate of the driving transistor M1. The source of the driving transistor M1 along with another terminal of the capacitor C1 are connected to the power source line VDD1, and the drain is connected to an anode of the EL element.

The power source line VDD1 which extends in the column direction is arranged on the side of the data line DATA1 opposite the pixel circuit R11. Since the power source line VDD1 is located at an end of a pixel matrix, it supplies power only to the column of the pixel circuit R11; however, a power source line located at other than the end has pixel circuits on both sides thereof and commonly supplies current to them. The power source line VDD2 supplies current to the pixel circuits of the column of pixel circuit G11 and the column of the pixel circuit B11 (not shown in FIG. 3), which is located next thereto.

The adjacent pixel circuit G11 has the same configuration and connection relationship as those of the pixel circuit R11. However, the arrangement of circuit elements such as transistors, capacities, and wirings in the pixel circuit G11 is in line symmetry with the pixel circuit R11 with the center line (the chain line of FIG. 3) between the two data lines being as the axis. The pixel circuit R11 and the pixel circuit G11 on an actual substrate are also configured such that each element thereof is arranged in symmetry. Thus, the pixel circuits R11 and G11, which are adjacent to each other in a row direction, include circuit elements such as transistors arranged in line symmetry with respect to an axis in the column direction.

It is noted that the circuit of FIG. 3 is an example, and other various pixel circuits are proposed. However, whatever the type of the pixel circuit is, the present invention is applicable to those in which adjacent two pixel circuits are in symmetrical relationship with each other. Even when the arrangement of the circuit element is not in symmetry, the present invention can be applied to any display apparatus in which the power source line VDD is placed alternately in every other space between pixel-circuit columns to be shared by the two columns of pixel circuits on both sides, and the data lines are arranged in pair of two in the space between pixel-circuit columns where there is no power source line.

Figure 4:
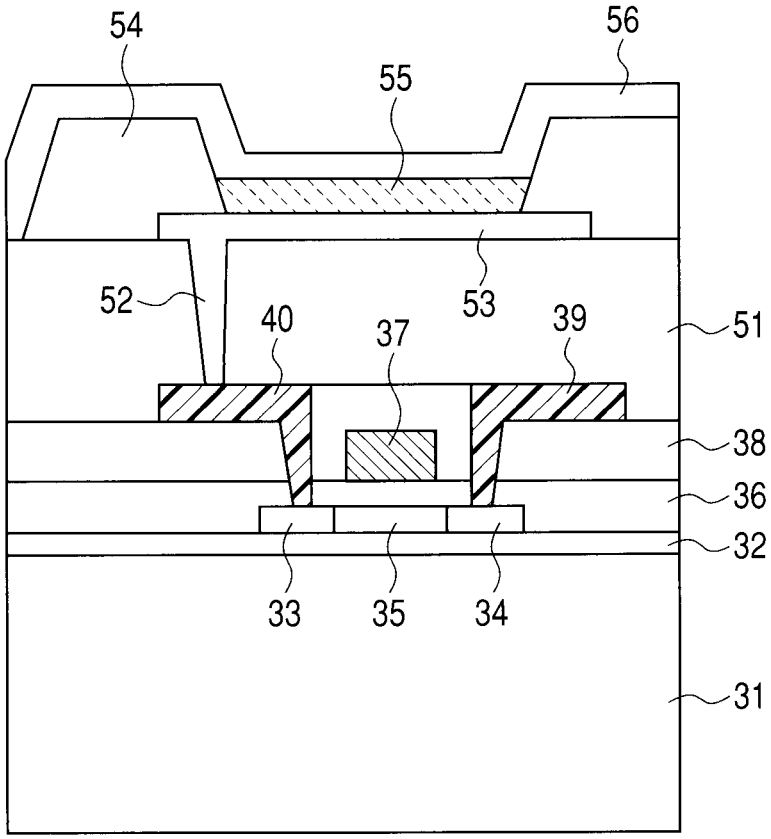
FIG. 4 is a sectional view of a pixel of the first example.

Among the components of a pixel circuit, an EL element is specially arranged with respect to other circuit elements. FIG. 4 schematically illustrates a sectional structure of a pixel.

In FIG. 4, a substrate 31 is coated with an undercoat layer 32, and a semiconductor layer is formed and patterned thereon. The semiconductor layer is separated into a drain region 33 and a source region 34 where impurity concentration is high, and a channel region 35 therebetween where impurity concentration is low.

The semiconductor layer is coated with a gate insulation film 36 and a gate electrode 37 is formed in a region corresponding to the channel region.

The tops of the gate electrode 37 and the gate insulation film 36 are covered with an interlayer insulation film 38, and on the interlayer insulation film 38, a source electrode 39 connected to the source region 34 of the semiconductor layer and a drain electrode 40 connected to the drain region 33 are respectively formed. The semiconductor layer, the gate electrode 37, the source electrode 39, and the drain electrode 40 of FIG. 4 correspond to the driving transistor M1 of the pixel circuit of FIG. 3.

On the substrate 31, there is not only a driving transistor M1, but also a switching transistor M2 of the same sectional structure, a capacitor C1, and a wiring layer which is formed in the same layer as that of the gate electrode or source/drain electrode. These elements are omitted in FIG. 4.

The power source line VDD and the data line DATA are patterned and arranged in the same layer as the source/drain electrode 39 and 40. Moreover, the scanning line VS is arranged in the same layer as that of the gate electrode 37 by being patterned separately from the gate electrode 37.

The top of the driving transistor M1 is covered with an insulating planarized layer 51. On the top of the planarized layer, one electrode (anode) 53 of an EL element is patterned and formed, and is connected to the drain electrode 40 of the driving transistor M1 through a contact hall 52 made through the planarized layer 51.

There is formed on the anode, an organic EL layer 55, which is further coated with the other electrode (cathode) 56 of the EL element. The peripheries of the anode 53 and the organic EL layer 55 are surrounded by an element separation film 54 for separating them from an adjacent EL element.

Thus, the EL element EL is formed further on top of the pixel circuit made up of a semiconductor layer and electrodes partially overlapping with those circuit elements. The light emission of the EL element is taken out from the side opposite to where the pixel circuit is located, that is, to the upward of FIG. 4.

Three sampling signal lines, to which sampling signals SP1, SP2 and SP3 of FIG. 2 are applied, are connected to the gates of TFTs making up a sampling switch.

In the present example, one image signal line is connected only either to a data line of an odd column or a data line of an even column. This assures that coupled two adjacent data lines are connected to different image signal lines. As a result, it is possible to control the sampling switch of the two parallel running data lines of the same pixel-circuit column group by the same sampling signal.

The two sampling switches to which data line DATA1 and the data line DATA2 are respectively connected are controlled by the sampling signal SP1. Moreover, the two sampling switches to which a data line DATA3 and a data line DATA4 are respectively connected are controlled by the sampling signal SP2. Further, the sampling switches to which a data line DATA5 and a data line DATA6 are respectively connected are controlled by a sampling signal SP3. In data lines DATA7 to DATA12 as well, the sampling switches which are similarly connected to each data line are controlled by any of the sampling signals SP1 to SP3.

Thus making the sampling timing to be identical for the pair of data lines which are arranged side by side enables to prevent a cross-talk due to sampling operation of the pair of data lines arranged side by side to the data line potential during sampling and holding.

Moreover, the configuration in which two data lines and a power source line are arranged alternately in a plurality of pixel-circuit columns enables to improve the layout efficiency. Further, since the power source line is commonly connected for the pixel circuits of the adjacent columns, the wiring of the power source line can be simplified.

Figure 5:
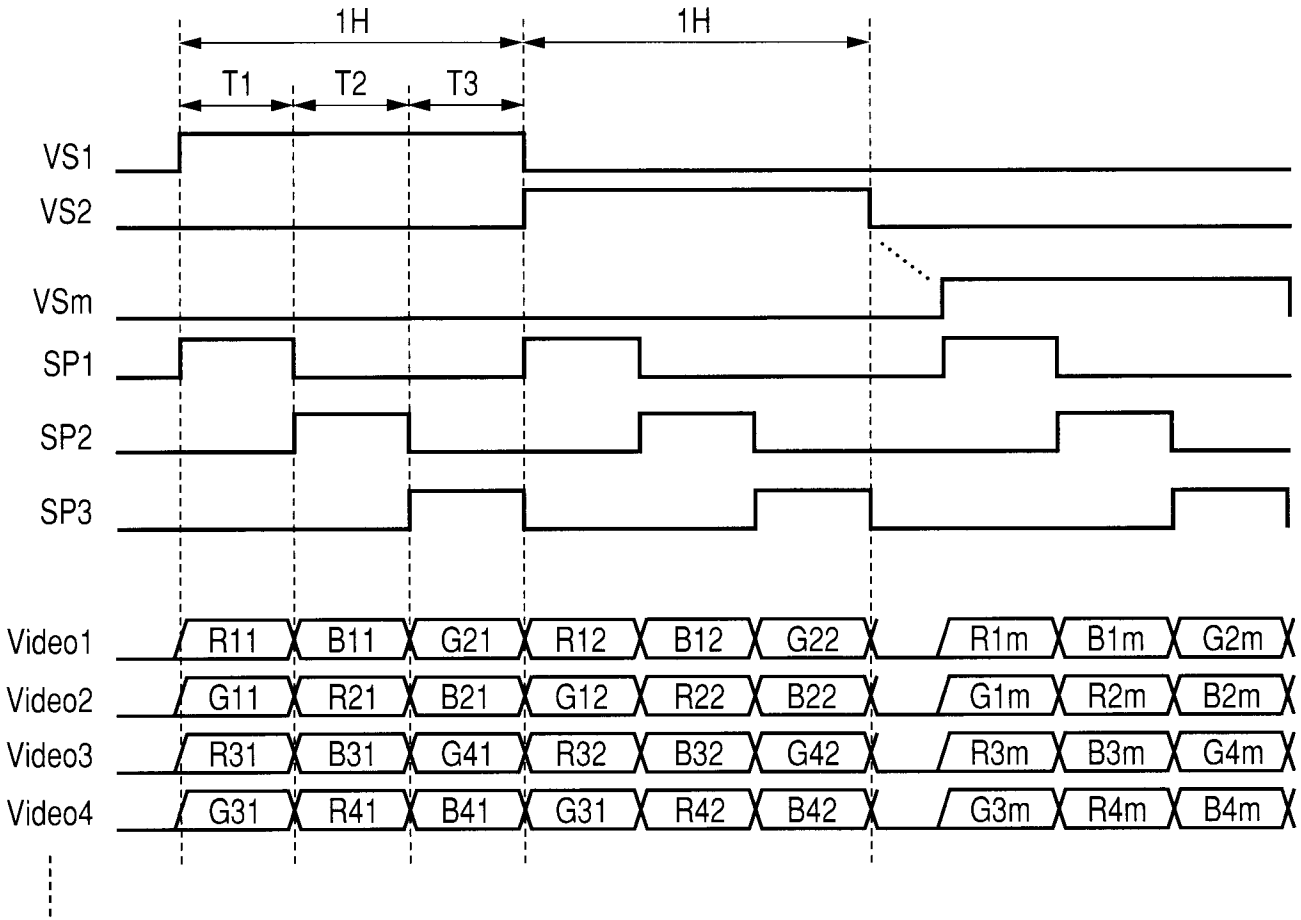
FIG. 5 is a timing chart to illustrate the operation of the first example.

FIG. 5 is a timing chart to describe the operation of the display apparatus of FIG. 2.

During a period 1H in which the scanning line 3 selects a row of pixel circuits, there are first to third sampling periods T1, T2 and T3 and image signals, which are transmitted in a time division manner to each of the image signal lines Video1 to Video4, are sampled into the data lines DATA1 to DATA12.

In a first 1H period, the pixel circuits of the first row are selected and, in the first sampling period T1 (the period in which the sampling signal SP1 is at an H level), an image signal R11 of the image signal line Video1 is output to a pixel circuit R11 and an image signal G11 of the image signal line Video2 is output to a pixel circuit G11.

Moreover, an image signal R31 of the image signal line Video3 is output to a pixel circuit R31, and an image signal G31 of the image signal line Video4 is output to a pixel circuit G31. In the same manner as described above, image signals of Video639 and Video640 are output to a pixel circuit R6391 and a pixel circuit G6391.

Next, in the second sampling period T2 (the period in which the sampling signal SP2 is at an H level), an image signal B11 of the image signal line Video1 is output to a pixel circuit B11 and an image signal R21 of the image signal line Video2 is output to a pixel circuit R21. Moreover, an image signal B31 of the image signal line Video3 is output to a pixel circuit B31 and an image signal R41 of the image signal line Video4 is output to a pixel circuit R41. In the same manner as described above, image signals of Video639 and Video640 are output to a pixel circuit B6391 and a pixel circuit R6401.

In the third sampling period T3 (the period in which the sampling signal SP3 is at an H level), an image signal G21 of the image signal line Video 1 is output to a pixel circuit G21 and an image signal B21 of the image signal line Video2 is output to a pixel circuit B21. Moreover, an image signal G41 of the image signal line Video3 is output to a pixel circuit G41 and an image signal B41 of the image signal line Video4 is output to a pixel circuit B41. In the same manner as described above, image signals of the Video639 and Video640 are output to a pixel circuit G6401 and a pixel circuit B6401 thereby finishing the sampling of all the columns.

In the next 1H, the pixel circuits of the second row are selected and the same operation is repeated. Hereafter, rows are successively selected and the selection of all of the 800 rows is finished to complete the image display of one frame.

In general, in a line successive driving such as one for connecting image signal lines of a number of (the number of rows/the number of colors), the sampling switch is controlled for each color by the same sampling signal.

Suppose that Video1 supplies image signals of red to the 1st, 4th and 7th columns, Video2 supplies image signals of green to the 2nd, 5th and 8th columns, Video 3 supplies image signals of blue to the 3rd, 6th and 9th columns, and hereafter in the same manner as before, one image signal line is configured to transmit image signals to three data lines of the same color. At this moment, adjacent data lines of one RGB group are sampled at the same time and a next RGB group is sampled at a different timing. As a result of that, in a pixel-circuit column group which is in a flip arrangement, two types of pixel circuit group may take place: one in which the samplings of two data lines are performed at the same timing and one in which the samplings are performed at different timings. This would make the correction of pixel data difficult.

As in the present example, when it is configured that one of the two image signal lines supplies image signals to the data lines of odd columns, and the other to the data lines of even columns, the coupled two data lines of a pixel-circuit column group are assuredly connected to different image signal lines. Since the two image signal lines can concurrently close respective switches to perform sampling, two data lines forming a pair can always perform sampling concurrently.

The image signal lines Video1 to Video4 of the present example causes image signals corresponding to at least different colors to be output at the same sampling timing according to the connection between the data line and the sampling switch.

Since the two data lines, which are sampled at different timings, are spaced apart with two columns of pixel circuits interposed therebetween, they will not be susceptible to voltage variation.

In the above description, description has been made taking an example of pixel array for repeating three colors of RGB, pixels may be combined arbitrary such as a repetition of four colors of RGBG and a repetition of four colors of RGBW, etc.

Figure 8:
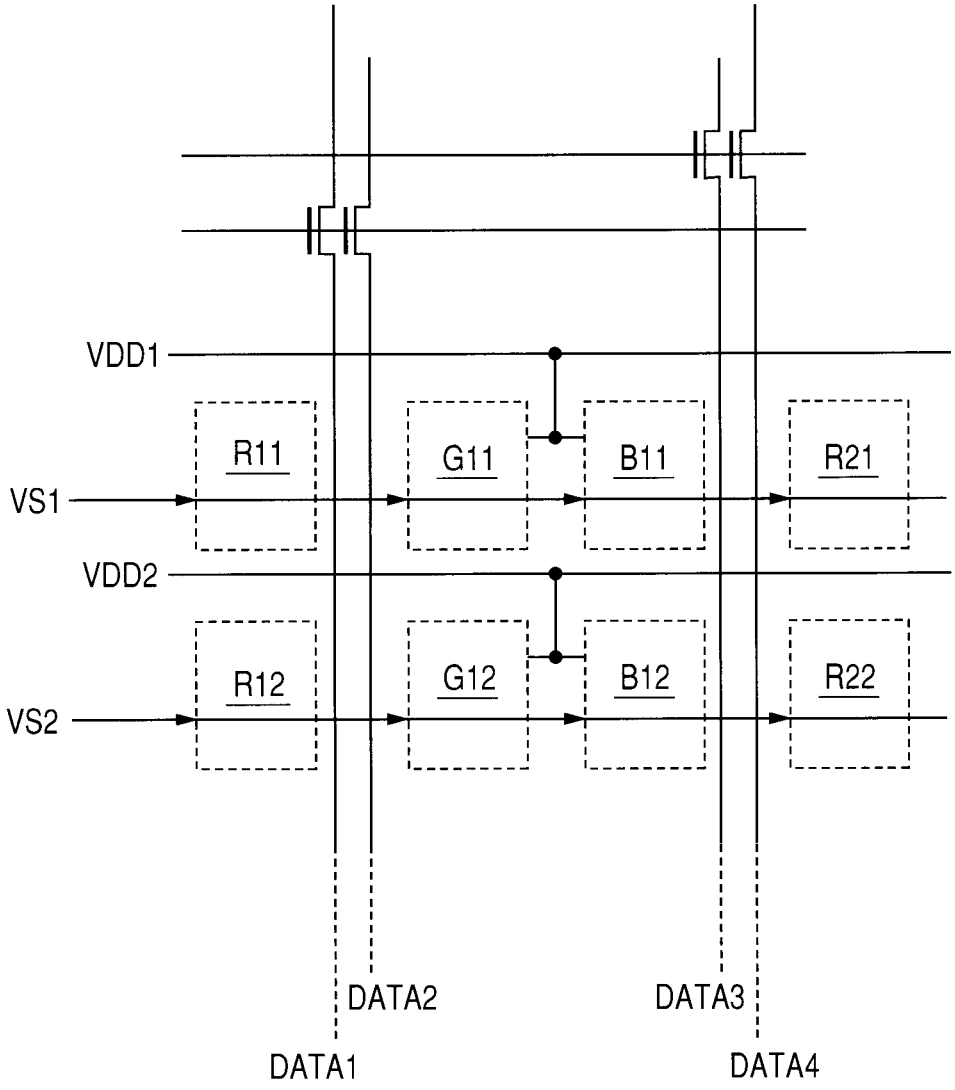
FIG. 8 illustrates a layout of a power source line.

It is noted that although the power source line extends in the column direction (longitudinal direction of FIG. 2) in FIG. 2, configuration may be such that the power source line extends in the row direction (lateral direction of FIG. 2) so that power source to be supplied to driving transistors in pixel circuits is distributed between adjacent pixel circuits. FIG. 8 is an example of such arrangement.

In FIG. 8, the power source line VDD1 is connected to sources which will be control electrodes of the driving transistors of the pixel circuits G11 and B11. Although the power source line VDD1 extends in the row direction, distributing the power source to adjacent pixel circuits of the same row as with a pixel circuit G11 and a pixel Circuit B11 enables to decrease the pitch of pixel circuits in the row direction. In such a case, a couple of data lines are arranged in where there is no connection between the power source lines and the pixel circuits.

Figure 9:
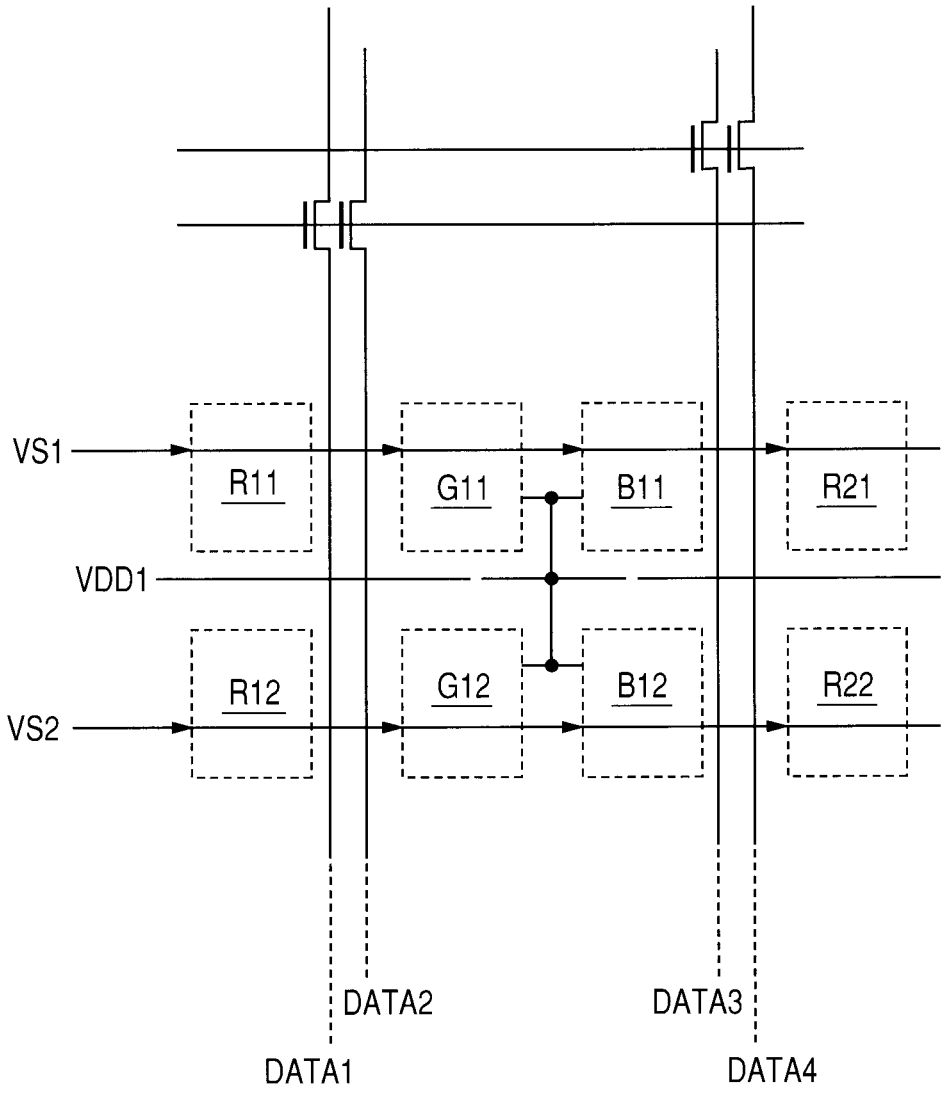
FIG. 9 illustrates another layout of the power source line.

Similarly, as illustrated in FIG. 9, the power source line may be shared by four pixel circuits adjacent to each other in the row and column directions. In FIG. 9, the power source line VDD1 is connected to the source which will be the control electrode of the driving transistor of each of the pixel circuits G11 and B11. Moreover, the power source line VDD1 is connected to the source which will be the control electrode of the driving transistor of each of the pixel circuits G12 and B12. In FIGS. 8 and 9, the power source line may be divided into a wiring extending in the row direction and a distribution wiring which is connected to each pixel circuit via the wiring and a contact hole. In this case, the power source line and the distribution wiring are formed of different layers. It is a matter of course that a wiring part extending in the row direction and a distribution wiring part may be formed of the same layer to provide a power source line.

Example 2

Figure 6:
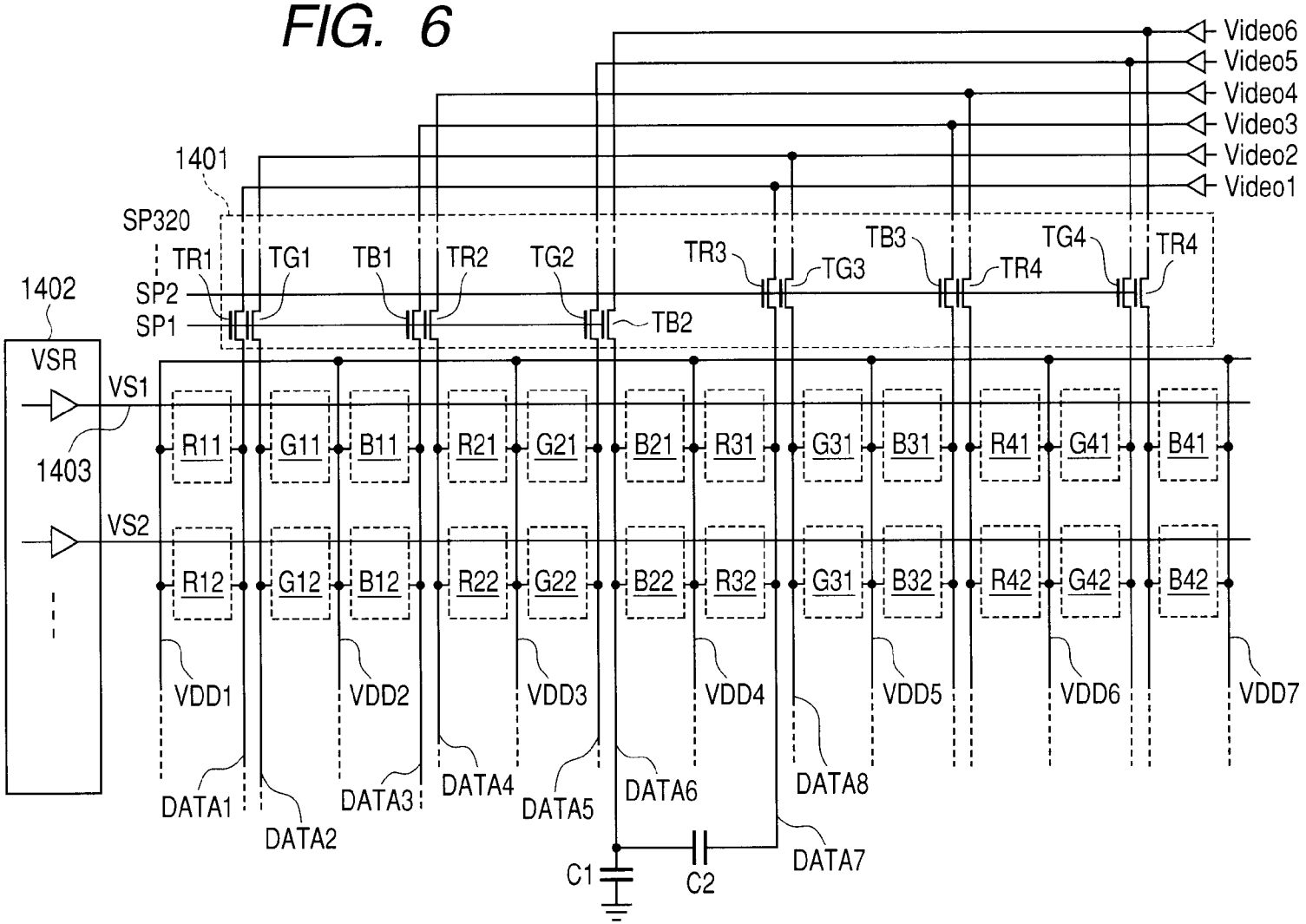
FIG. 6 is circuit diagram of a second example.

FIG. 6 is a circuit block diagram to illustrate the configuration of a second example of the display apparatus relating to the present invention. A pixel circuit is made up of an organic EL light emitting element and a circuit for supplying current thereto, and is arranged in the form of a matrix of 800 rows and 1920 columns.

The display apparatus of FIG. 6 is, as with the example 1, connected with an integrated circuit chip not illustrated in the figure, and from the data line driving circuit contained in the integrated circuit chip, 6 lines of image signals are output to the image signal lines Video1, Video2, . . . , Video6. The image signal lines Video1 to Video 6, which are a wiring along the upper side of the pixel circuits arranged in a matrix form, transmit image signals to data lines DATA1, DATA2, . . . , DATA1920.

The sampling switch group 1401 is a matrix switch which is provided according to the intersections between the data lines and the image signal lines for feeding image signals thereto. In the present example, image signal lines, each of which is connected to one data line for every 6 columns of data lines, are connected to a total of 320 columns of data lines to supply image data to each data line in a time division manner.

The image signal line Video1 supplies image signals to the data lines of the 1st, 7th, 13th, 19th, columns, the image signal line Video 2 to the data lines of the 2nd, 8th, 14th, 20th, columns and, in the same manner as before, each image signal line selects one out of every 6 data lines to supply image signals thereto.

The matrix switches of the sampling switch group 1401 are each made up of one TFT switch provided corresponding to each data line. Each switch connects a data line and an image signal line for transmitting image signal thereto. One end of the switch is connected to the data line, and the other end to the image signal line.

The sampling signals SP1, SP2, . . . , SP320 for closing switches to send image signals to data lines are input to the gate of each TFT switch by the signal lines of a number equal to (the number of data lines/the number image signal lines), that is, 320 in the present example.

In FIG. 6, image signal lines Video1 to Video6, through which image signals are output from a data line driving circuit not illustrated, are wired and are input to the sampling switch group 1401. The sampling signals SP1 to SP320 are input to the gates of the transistors by 320 sampling signal lines. Each sampling signal line is supplied with sampling signals SP1 to SP320, respectively.

Although FIG. 6 illustrates 12 data lines and 7 power source lines, in reality, 1920 data lines DATA1 to DATA1920 and 961 power source lines VDD1 to VDD961 are provided.

The sampling switch group 1401 turn on when the sampling signals SP1 and SP2 are at an H level and sample image signals into the data lines. On the other hand, the sampling switch group 1401 turn off when the sampling signals SP1 and SP2 are at an L level, and hold the immediately preceding levels of signal images in the data lines.

The scanning line 1403 is connected to a first pixel-circuit row made up of pixel circuits R11, G11, B11, R21, . . . and a second pixel-circuit row made up of pixel circuits R12, G12, B12, R22, The scanning line 1403 is applied with scanning signals VS1, VS2, . . . for controlling the writing of data line information into pixel circuits. The scanning signal is generated by a scanning signal generation circuit (VSR) 1402.

Between adjacent pixel-circuit columns, two data lines disposed in parallel and a power source line are alternately disposed. For example, the data lines DATA3 and DATA4 are arranged between a pixel-circuit column (hereafter, referred to as a third pixel-circuit column) made up of a pixel circuit B11 and a pixel circuit B12, and a pixel-circuit column (hereafter, referred to as a fourth pixel-circuit column) made up of a pixel-circuit column R21 and a pixel-circuit column R22. Then, the data line DATA3 is connected to each pixel circuit of the third pixel-circuit column, and the data line DATA4 is connected to each pixel circuit of the fourth pixel-circuit column. A power source line VDD2 is arranged on the side of the third pixel-circuit column opposite to where the data line DATA3 is arranged, and a power source line VDD3 is arranged on the side of the fourth pixel-circuit column opposite to where the data line DATA4 is arranged.

The power source line VDD2 for supplying source voltage is commonly connected to each pixel circuit of the second pixel-circuit column (a pixel-circuit column made up of a pixel circuit G11 and a pixel circuit G12) and each pixel circuit of the third pixel-circuit column, which are arranged on both sides. Moreover, the power source line VDD3 is commonly connected to each pixel circuit of the fourth pixel-circuit column and each pixel of a fifth pixel-circuit column (a pixel-circuit column made up of a pixel circuit G21 and a pixel circuit G22), which are arranged on both sides.

The sampling signal lines to which sampling signals SP1 to SP320 are input are connected to gates of sampling switches. The sampling switches of coupled two data lines running parallel are controlled by the same sampling signal.

For example, the sampling switches connected respectively to the data lines DATA1 to DATA6 are controlled by the sampling signal SP1. The sampling switches connected respectively to the data lines DATA7 to DATA12 are controlled by the sampling signal SP2. In this way, the sampling switches connected respectively to data lines DATA13 to DATA18, . . . , DATA1914 to DATA 1920 are controlled by the sampling signals SP3, . . . , SP320.

In that case, the configuration is made such that data lines, which are connected to sampling switches that are controlled by different sampling signals, are not formed into a group of two which run parallel.

For example, suppose that the data line DATA6 and the data line DATA7 are controlled by different sampling signals SP1 and SP2, and that the sampling signal SP1 is at a L level and a signal is held in the data line DATA6. Then, when the sampling signal SP2 turns to an H level and a data line DATA7 is sampled, the data line DATA6 will be affected by the data line DATA7 due to a cross-talk if parasitic capacities of the data line DATA6 and the data line DATA 7 exist.

To prevent that, the data line DATA6 and the data line DATA7 are arranged with two pixel circuits and a power source line interposed therebetween. This arrangement makes a parasitic capacity C2 between the data line DATA6 and the data line DATA7 smaller than a wiring capacity C1 thereby enabling to suppress cross-talk.

In the present example, the configuration is made such that the sampling timings of a pair of data lines which are arranged side by side are identical, and the data lines which are connected to sampling switches of different sampling timings are spaced apart by a pixel circuit and a power source line, etc. As a result of that, it is possible to prevent a cross-talk to a data line potential being held due to the sampling operation of data lines running parallel.

The present example is configured such that the number of image signal lines is 6, and one image signal line transmits data at a rate of one out of 6 data lines. Therefore, two data lines running side by side between pixel-circuit columns assuredly fall into a group of 6 data lines and receive image signals by the same sampling signal at the same time.

When there are an even number of image signal lines and each of which is connected one by one by a switch to a data line selected from a group of data lines of the same even number, two data lines which run side by side between pixel-circuit columns assuredly receive image signals from the image signal lines at the time by the same sampling signal. As a result of that, those two data lines will not affect each other's voltage and the image signals are accurately sampled.

Figure 7:
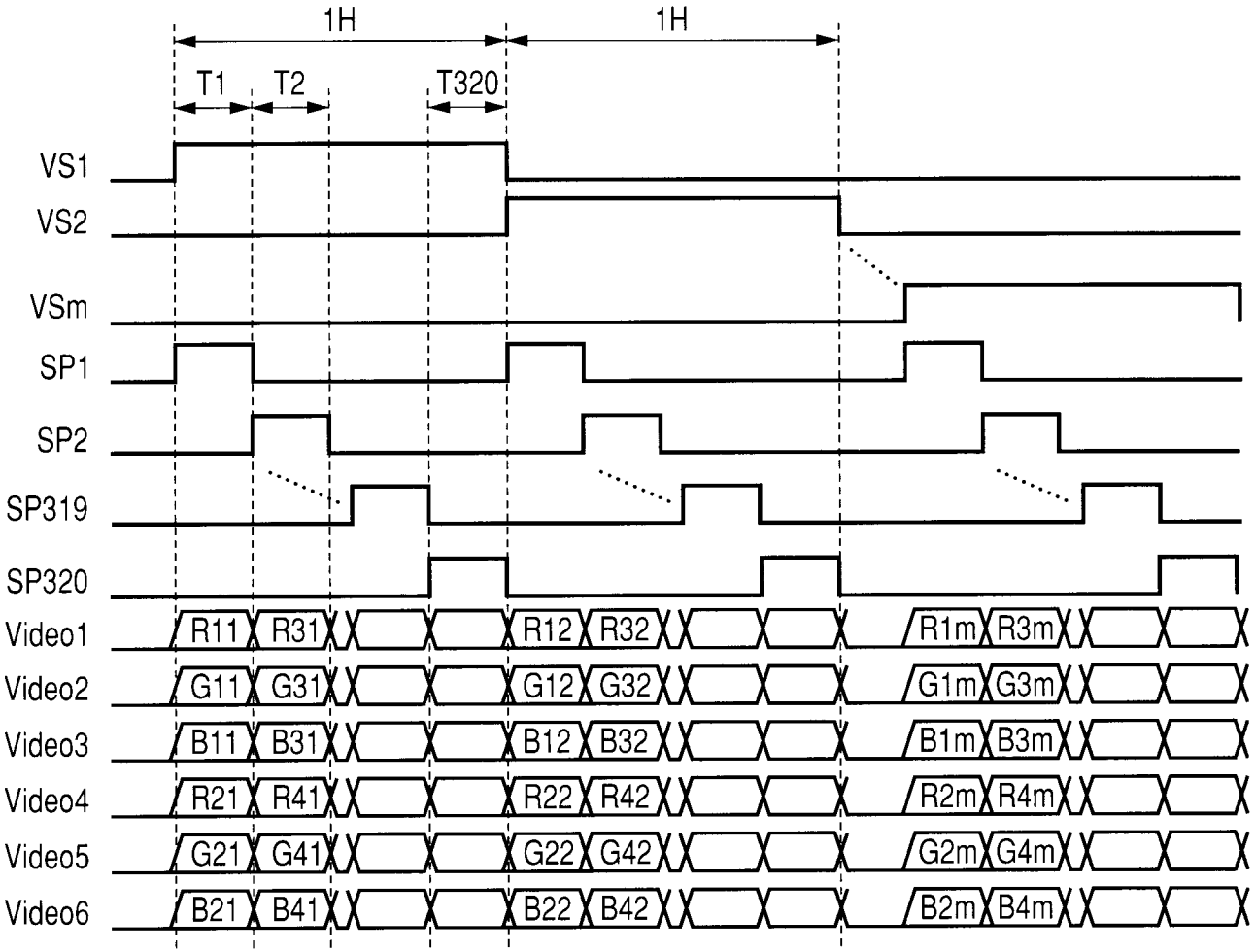
FIG. 7 is a timing chart to illustrate the operation of the second example.

To perform display operation by the above described configuration, operations as illustrated in the timing chart of FIG. 7 are performed.

In the first to 320th sampling periods T1 to T320 in the sampling period of one row, image signals of 320 image signal lines Video1 to Video6 are sampled into the data lines DATA1 to DATAM.

In the first 1H, the first pixel-circuit row is selected.

In the first sampling period T1 (a period in which the sampling signal SP1 is at an H level), an image signal R11 of the image signal line Video1 is output to a pixel circuit R11, and an image signal G11 of the image signal line Video 2 is output to a pixel circuit G11. Moreover, an image signal B11 of the image signal line Video3 is output to a pixel circuit B11 and an image signal R21 of the image signal line Video4 is output to a pixel circuit R21. Further, an image signal G21 of the image signal line Video5 is output to a pixel circuit G21 and an image signal B21 of the image signal line Video6 is output to a pixel circuit B21.

In the second sampling period T2 (a period in which the sampling signal SP2 is at an H level), an image signal R31 of the image signal line Video1 is output to a pixel circuit R31, and an image signal G31 of the image signal line Video2 is output to an pixel circuit G31. Moreover, an image signal B31 of the image signal line Video3 is output to a pixel circuit B31, and image signal R41 of the image signal line Video4 is output to a pixel circuit R41. Further, an image signal G41 of the image signal line Video5 is output to a pixel circuit G41, and an image signal B41 of the image signal line Video6 is output to a pixel circuit B41.

Hereafter, successively in each of the third sampling period T3 to the 320th sampling period T320, image signals of the image signal lines Video1 to Video6 are output to corresponding pixel circuits.

In the last 320th sampling period T320 (a period in which the sampling signal SP320 is at an H level) of 1H, an image signal B6391 of the image signal line Video1 is output to a pixel circuit R6391; an image signal G6391 of the image signal line Video2 to a pixel circuit G6391; an image signal B6391 of the image signal line Video3 to a pixel circuit B6391; an image signal R6401 of the image signal line Video4 to a pixel circuit R6401; an image signal G6401 of the image signal line Video5 to a pixel circuit G6401; and an image signal B6401 of the image signal line Video6 to a pixel circuit B6401. Thus, the sampling of all the columns of 1H is completed.

In the next 1H, a pixel-circuit column in the second row is selected and the operation is repeated. Hereafter, in the same manner as before, rows are successively selected to finish the selection of all the 800 rows and thus the image display of one frame is completed.

The sampling switch group 1401 of the present example connect each image signal line of Video1 to Video6 to the data lines which are selected at an equal interval at a rate of one out of 6 lines. In general, the configuration is made such that according to the number (must be an even number) of image signal lines, data lines are selected at an equal interval at a rate of one from column blocks of a number equal to that of the image signal lines, and are connected to one image signal line. As a result of that, a pair of data lines belonging to the same pixel-circuit column group are connected to different image signal lines. Since the image signal line can close all of the switches connected thereto at the same time to perform sampling in unison, two data lines forming a pair can always perform sampling at the same time.

In the present example, the sampling signals are arranged and connected such that the sampling signal is identical not for each color but for adjacent data lines. Therefore, the image signal lines (Video1 to Video6) of the present embodiment cause image signals corresponding to at least different colors to be output at the same sampling timing according to the connection between the data line and the sampling unit.

Although, in the above description, description has been made taking an example of a pixel array for repeating three colors of RGB, pixels may be combined arbitrary such as in a repetition of four colors of RGBG and in a repetition of four colors of RGBW, etc. Moreover, the combination of the sampling signal and the number of lines of image signal will not be limited to what is described above.

The power source line of the above described example is assumed to extend in the column direction. However, the power source line may extend in the row direction. FIG. 8 is an example of such arrangement.

In FIG. 8, a power source line VDD1 is connected to sources which will be the control electrodes of the driving transistors of the pixel circuits G11 and B11. Although the power source line VDD1 extends in the row direction, distributing the power supply to adjacent pixel circuits in the same row, such as the pixel circuit G11 and the pixel circuit B11, enables to decrease the pitch of pixel circuits in the row direction. In such a case, the data lines are arranged also in groups of two in where there is no connection between the power source lines and the pixel circuits.

Similarly, as illustrated in FIG. 9, the power source line may be shared by four pixel circuits adjacent to each other in the row and column directions. In FIG. 9, the power source line VDD1 are connected to sources which will be the control electrodes of the driving transistors of the pixel circuits G11 and B11. Moreover, the power source line VDD1 is connected to the sources which will be the control electrodes of the driving transistors of the pixel circuits G12 and B12. In FIGS. 8 and 9, the power source line may be divided into a wiring extending in the row direction and a distribution wiring which is connected to each pixel circuit via the wiring and a contact hole. In this case, the power source line and the distribution wiring are formed of different layers. It is a matter of course that a wiring part extending in the row direction and a distribution wiring part may be formed of the same layer to provide a power source line.

The display apparatus of exemplary embodiment and each example described above may make up, for example, an information display apparatus. This information display apparatus takes on any of the forms of, for example, a portable phone, a portable computer, a still camera, and a video camera. Alternatively, the information display apparatus is an apparatus to realize a plurality of respective functions thereof. The information display apparatus includes an information input unit. For example, in the case of a portable telephone, the information input unit is configured to include an antenna. In the case of a PDA and a portable PC, the information input unit is configured to include an interface unit for networks. In the case of a still camera and a movie camera, the information input unit is configured to include a sensor unit based on a CCD and a CMOS, etc.

As the information display apparatus, a digital camera which utilizes an AM-type OLED display including a pixel circuit of the above described each example will be described.

Figure 10:
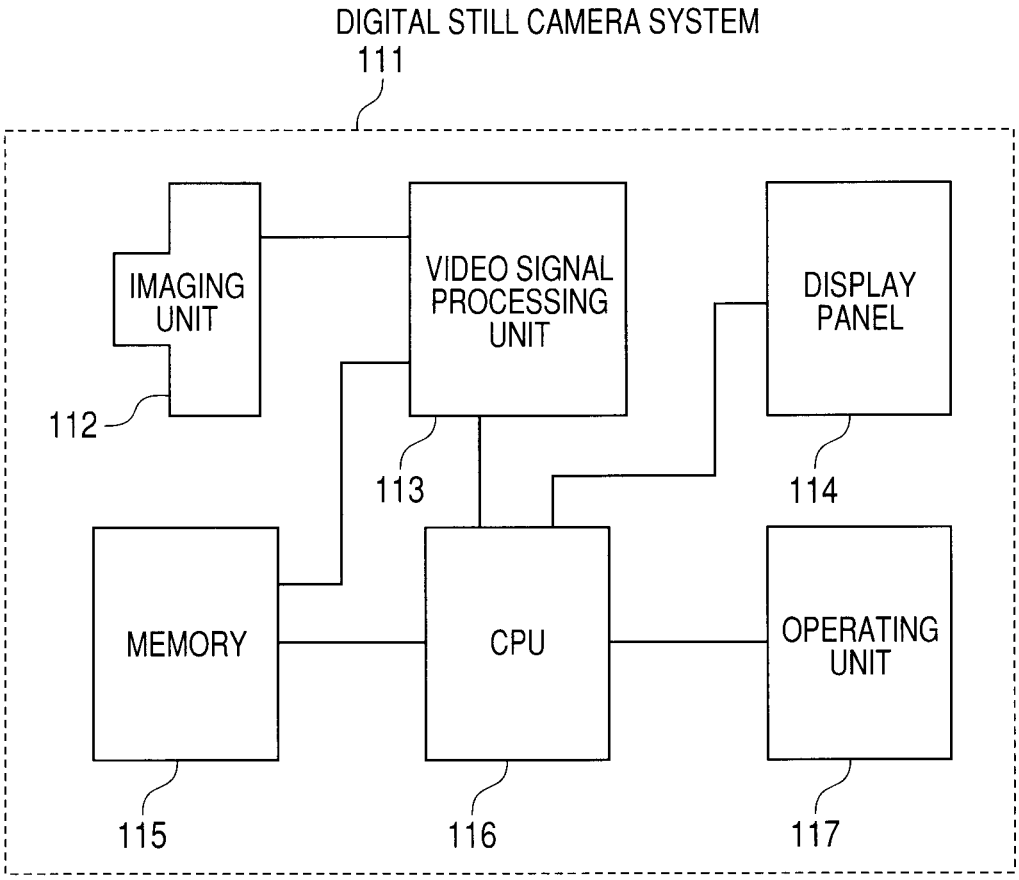
FIG. 10 is a block diagram to illustrate the configuration of a digital camera using an AM-type OLED display.

FIG. 10 is a block diagram of an example of a digital still camera. The figure illustrates a whole system 111, an imaging unit 112 for imaging an object, a video signal processing circuit (which makes up a video signal processing unit) 113, a display panel 114, a memory 115, a CPU 116, and an operating unit 117. A video image taken by the imaging unit 112 or a video image recorded in the memory 115 is subjected to signal processing at the video signal processing circuit 113 and is made visible on the display panel 114 serving as a display apparatus. The CPU 116 receives an input from the operating unit 117 and controls the imaging unit 112, the memory 115, and the video signal processing circuit 113, etc. to perform imaging, recording, replaying, and displaying according to the circumstances.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-294369, filed Nov. 18, 2008, which is hereby incorporated by reference herein in its entirety.

What is claimed is:

1. A display apparatus comprising:

data lines;

scanning lines arranged to cross the data lines;

pixel circuits aligning along the data lines and the scanning lines, such that one of the pixel circuits corresponds to each intersection between the data lines and the scanning lines, with each pixel circuit including a light emitting element and a transistor;

image signal lines for transmitting image signals; and sampling switches for connecting the data lines to the image signal lines so that each of the data lines is connected to one of the image signal lines, wherein the data lines are arranged such that adjacent data lines form a pair of data lines, and adjacent pairs of data lines are spaced apart from each other by two columns of pixel-circuits, respective data lines of the pair of data lines are connected by the sampling switches to two different image signal lines, and the sampling switches connecting the pair of data lines to corresponding image signal lines are activated simultaneously.

2. The display apparatus according to claim 1, wherein every even number-th data line is connected by the sampling switches to the same one of the image signal lines.

3. The display apparatus according to claim 1, wherein the pixel circuits include three pixel circuits aligning periodically along the scanning lines, each of the three pixel circuits having a light-emission device which emits light colored with one of three different colors, and three corresponding data lines, each one being selected from one of the two data lines, are connected by the switches to a same image signal line at different timings.

4. The display apparatus according to claim 3, wherein three groups of the two data lines close to each other are connected by the sampling switches to two of the image signal lines.

5. The display apparatus according to claim 1, wherein two of the pixel circuits aligning along one of the scanning lines and connected to the pair of data lines include circuit elements arranged symmetrically with regard to a center line between the pair of data lines.

6. The display apparatus according to claim 1, further comprising power source supplying lines for supplying a source voltage to the pixel circuits, wherein the power source supplying lines are arranged along a pixel circuit boundary other than a pixel circuit boundary in which the pair of data lines are disposed.

7. The display apparatus according to claim 6, wherein each one of the power source supplying lines supplies the source voltage to the pixel circuits arranged on both sides of the one power supplying line.

8. A camera comprises a display apparatus according to claim 1;

an imaging unit for imaging an object;

an image signal processing unit for processing a signal derived by imaging using the imaging unit, wherein the display apparatus performs displaying based on an image signal derived by the processing using the image signal processing unit.

* * * * *